US008490310B2

(12) United States Patent
Tresserras Torre

(10) Patent No.: US 8,490,310 B2
(45) Date of Patent: Jul. 23, 2013

(54) TRIGGER MECHANISM FOR SPORTING RIFLE

(75) Inventor: Victor Tresserras Torre, Barcelona (ES)

(73) Assignee: GAMO Outdoor, SL, Barcelona (ES)

( * ) Notice: Subject to any disclaimer, the term of this patent is extended or adjusted under 35 U.S.C. 154(b) by 83 days.

(21) Appl. No.: 13/130,679

(22) PCT Filed: Nov. 27, 2008

(86) PCT No.: PCT/ES2008/070216

§ 371 (c)(1),
(2), (4) Date: May 23, 2011

(87) PCT Pub. No.: WO2010/061010

PCT Pub. Date: Jun. 3, 2010

(65) Prior Publication Data

US 2011/0225863 A1 Sep. 22, 2011

(51) Int. Cl.
*F41A 17/46* (2006.01)

(52) U.S. Cl.
USPC ..... 42/69.01

(58) Field of Classification Search
USPC ..... 42/69.01, 40, 41, 42.01, 42.02, 70.06, 42/70.07; 89/27.11, 27.3, 150; 124/31
See application file for complete search history.

(56) References Cited

U.S. PATENT DOCUMENTS

| | | | | | |
|---|---|---|---|---|---|
| 236,791 | A * | 1/1881 | Dunlap | 42/41 |
| 495,298 | A * | 4/1893 | Parry et al. | 42/41 |
| 495,639 | A * | 4/1893 | Sachs | 42/41 |
| 523,130 | A * | 7/1894 | Sachs | 42/40 |
| 594,863 | A * | 12/1897 | Elterich | 42/41 |
| 1,792,732 | A * | 2/1931 | Crawford | 42/41 |
| 3,153,874 | A * | 10/1964 | Merrill | 42/41 |

FOREIGN PATENT DOCUMENTS

| | | |
|---|---|---|
| DE | 11 13 164 | 8/1961 |
| DE | 18 10 211 | 6/1970 |
| EP | 0467089 | 1/1992 |
| ES | 8104552 | 7/1981 |
| FR | 1 378 793 | 11/1964 |

OTHER PUBLICATIONS

International Search Report for PCT/ES2008/070216 dated Sep. 4, 2009.

* cited by examiner

*Primary Examiner* — Michael Carone
*Assistant Examiner* — Reginald Tillman, Jr.
(74) *Attorney, Agent, or Firm* — Hartman Global IP Law; Gary M. Hartman; Domenica N. S. Hartman

(57) ABSTRACT

A firing mechanism for a sporting rifle includes a piston, a rigid profile, a trigger and a trigger safety catch. A wall is firmly attached to the rigid profile. The trigger and safety catch are on one of the faces of said wall. A first stud is firmly attached to the trigger. A cover partially covers the trigger and safety catch. The cover includes an aperture, in the form of a slider, allowing the first stud to pass through it and for movement of the first stud along the length of the aperture. A slider is arranged over the cover. When the barrel is in the broken position, the slider will block the movement of the stud along the length of the aperture, thus immobilizing the trigger. When the barrel is in the closed position, the slider allows movement of the first stud along the aperture.

14 Claims, 5 Drawing Sheets

TRIGGER MECHANISM FOR SPORTING RIFLE

This application is the U.S. national phase of International Application No. PCT/ES2008/070216 filed 27 Nov. 2008 which designated the U.S., the entire contents of which is hereby incorporated herein by reference.

A trigger mechanism for a sporting rifle of the type that comprises a piston, a rigid profile and a trigger safety catch and because it also has a wall, firmly attached to the rigid profile, which comprises the trigger and safety catch on one of the faces of said wall and similarly with the other face free, a first stud firmly attached to the trigger, a cover that partially covers the trigger and safety catch and said cover consists of an aperture, in the form of a slider, allowing the first stud to pass through it and for the movement of said first stud along the length of said aperture and a slider arranged over the cover in which, with the barrel broken, the referred slider will block the movement of said stud along the length of the aperture, thus immobilising the trigger and, in the closed barrel position, the mentioned slider allows the movement of the first stud along the aperture.

BACKGROUND OF THE INVENTION

The inventor is known in the sporting rifle sector as a great innovator, especially in relation to compressed air and $CO_2$ rifles and pistols. Within this line improvement, this patent refers to a trigger for sporting rifles.

Thus, Spanish Patent 0493802 (ES8104552) "Compressed air gun", is known from 1980, in the name of AIR MATCH, S.A.R.L., which refers to a compressed air gun. It basically comprises a frame, a barrel mounted on the same, a butt that can be closed against a stationary shoulder, a chamber with a displaceable piston to action of suction and compression air a trigger mechanism, which can be applied to or separated from the block in its assembly. The compression chamber closes and opens by the valve and communicates with the barrel by the passes. The piston is bolted to an operating lever to action the suction and compression movements. Firing is produced by trigger action which, by means of a series of levers and mechanisms, operates the impulse lever and the valve. Of application for mounting in pistol or carbine shaped.

European Patent 0467089 "Semi-automatic compressed gas pistol" is also known from 1991, in the name of Mr Thomas G. KOTSIOPOULOS, which refers to a compressed gas pistol fitted with a semi-automatic firing mechanism to allow sequences of successive shots. The trigger mechanism includes a lock with a latch arm, with a cam at one end and interconnection elements at the other end. The cam is positioned to close the firing chamber as the latch arm rotates. The interconnection is positioned to releases an actuator bolt as the latch arm rotates. A rewind spring repositions the actuator bolt in order to link up with the interconnection element once the firing chamber is discharged.

DISCLOSURE OF THE INVENTION

This invention is an improvement sporting rifle sector in concrete in the compressed air or $CO_2$ With the present invention, the inventor goes one step further in the idea of providing a maximum quality product, without any operating errors or failures, together with simple mechanical assembly.

Thus, a trigger mechanism has been developed based on assembling the entire mechanism on a fixed profile of the sporting rifle, as if they were different layers, which facilitates both assembly and disassembly.

Such mechanisms usually require assembly on both sides of the rifle, fitting covers on one side with another to cover the mechanism.

A rigid profile has been developed that is used for, on the one hand, a chamber support and, on the other, extends downwards in the form of a wall and forms a support for the entire trigger mechanism and the piston release mechanism.

Assembly is performed in the form of layers and in this way facilitates the assembly, with significant reductions in costs and handling time.

At the same time, the piston blocking time has been improved when loading the rifle because the rod, on the one hand, is coupled to a lever mechanism and, on the other, to a slider which, moved when the rifle is articulated for loading, it slides and blocks the trigger. Because this function is performed with two articulated parts, loading safety catch operation is guaranteed since any possible misalignment or alignment defects will not block the system, thus improving efficiency.

Safety catch efficiency has also been improved, which reduces costs. This was achieved by using an ellipsoidal aperture, with a narrowing in the central zone. This special configuration creates two safety catch positions and, in the activated position, this blocks the trigger preventing it from being operated.

This improvement is significant because it means substantial economic savings in labour, because it reduces the number of parts to handle and also reduces the possibility of failure because it replaces the use of springs, sheet metal parts and shafts etc.

Another improvement of this invention is that the trigger is a single piece and is automatically centred by a stud.

One objective of this invention is a trigger mechanism for a sporting rifle of the type comprising a piston, rigid profile, a trigger and trigger safety catch characterised in that it has a wall, firmly attached to the rigid profile, which comprises the trigger and safety catch on one of the faces of said wall and similarly with the other face free, a first stud firmly attached to the trigger, a cover that partially covers the trigger and safety catch and said cover consists of an opening, in the form of a slider, allowing the first stud to pass through it and for the movement of said first stud along the length of said aperture and a slider arranged over the cover, in which, with the barrel broken, the referred slider will block the movement of said first stud along the length of the aperture, thus immobilising the trigger and, in the closed barrel position, the mentioned slider allows the movement of the first stud along the aperture.

BRIEF DESCRIPTION OF THE DRAWINGS

In order to facilitate the description, this report includes five sheets of drawings on which a practical exemplary embodiment is represented, which is cited as a non-limiting example of scope of the present invention.

SPECIFIC EXEMPLARY EMBODIMENT OF THIS INVENTION

Figure 1:
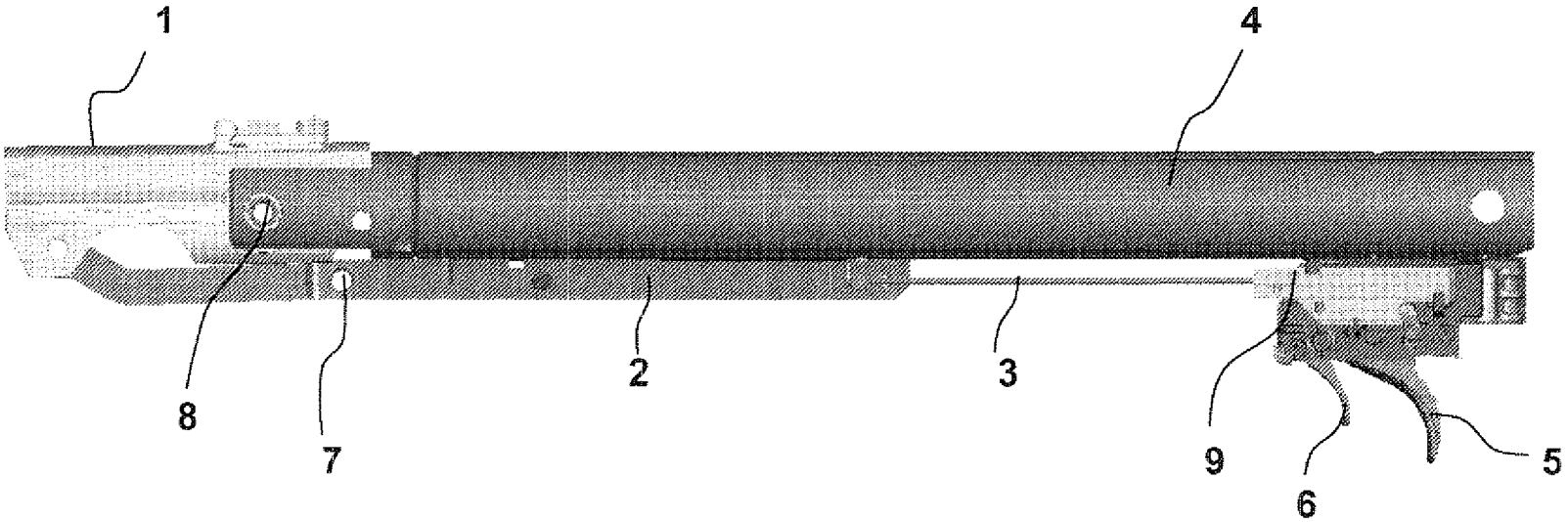
FIG. 1 is a lateral view, with a partial view of the barrel of the rifle covered by this invention.

Thus, FIG. 1 illustrates barrel 1 that is joined to chamber 4 by a second articulation 8, a lever mechanism 2, with its first articulation 7, a rod 3, a trigger 5, a safety catch 6 and a slider 9.

Figure 2:
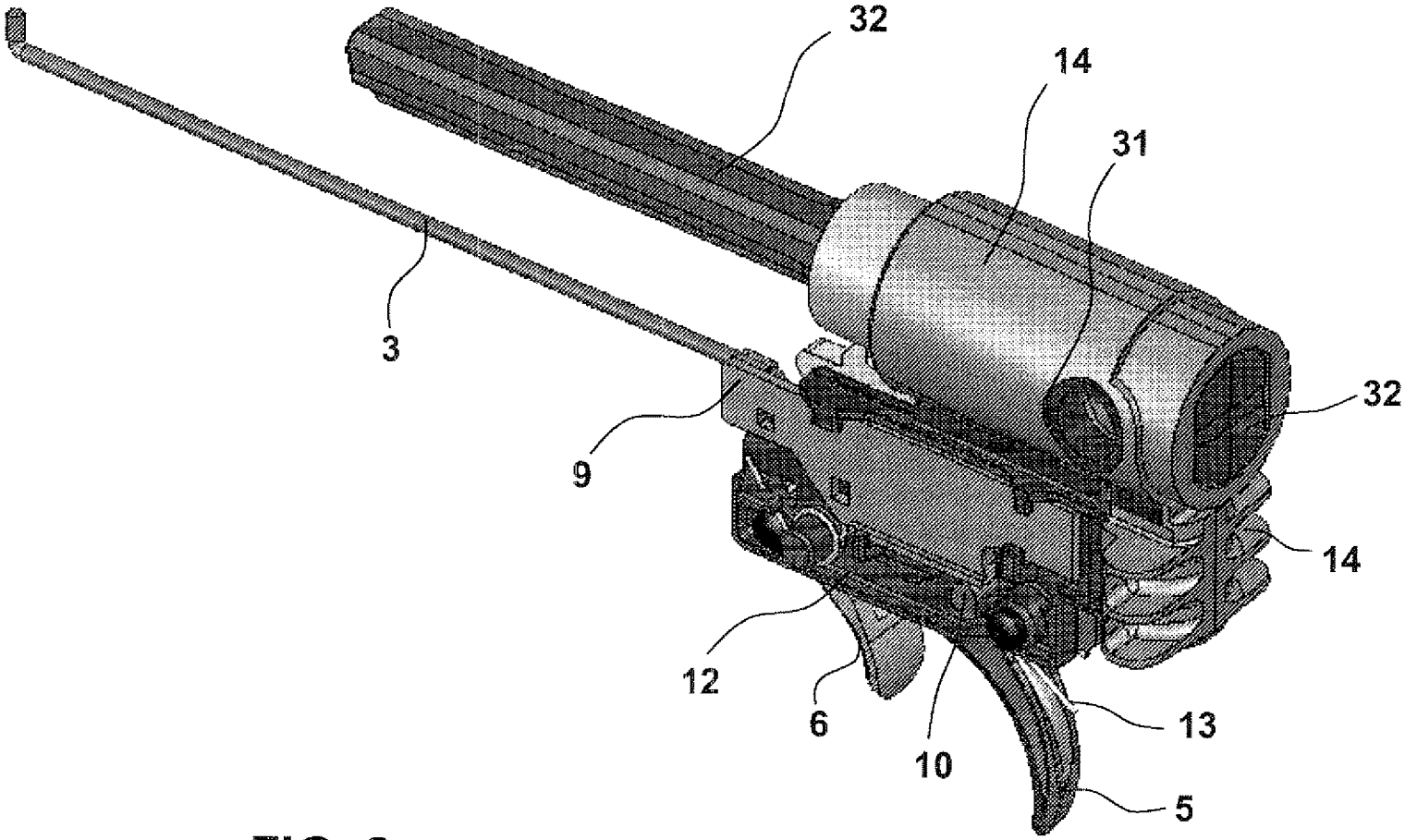
FIG. 2 is a partial perspective view of the trigger mechanism from behind, with the spring guide and the rod.

FIG. 2 represents rod 3, slider 9, trigger 5, with first spring 13, safety catch 6, rigid profile 14, spring guide 32, damping washer 31, cover 12 and trigger stud 10.

Figure 3:
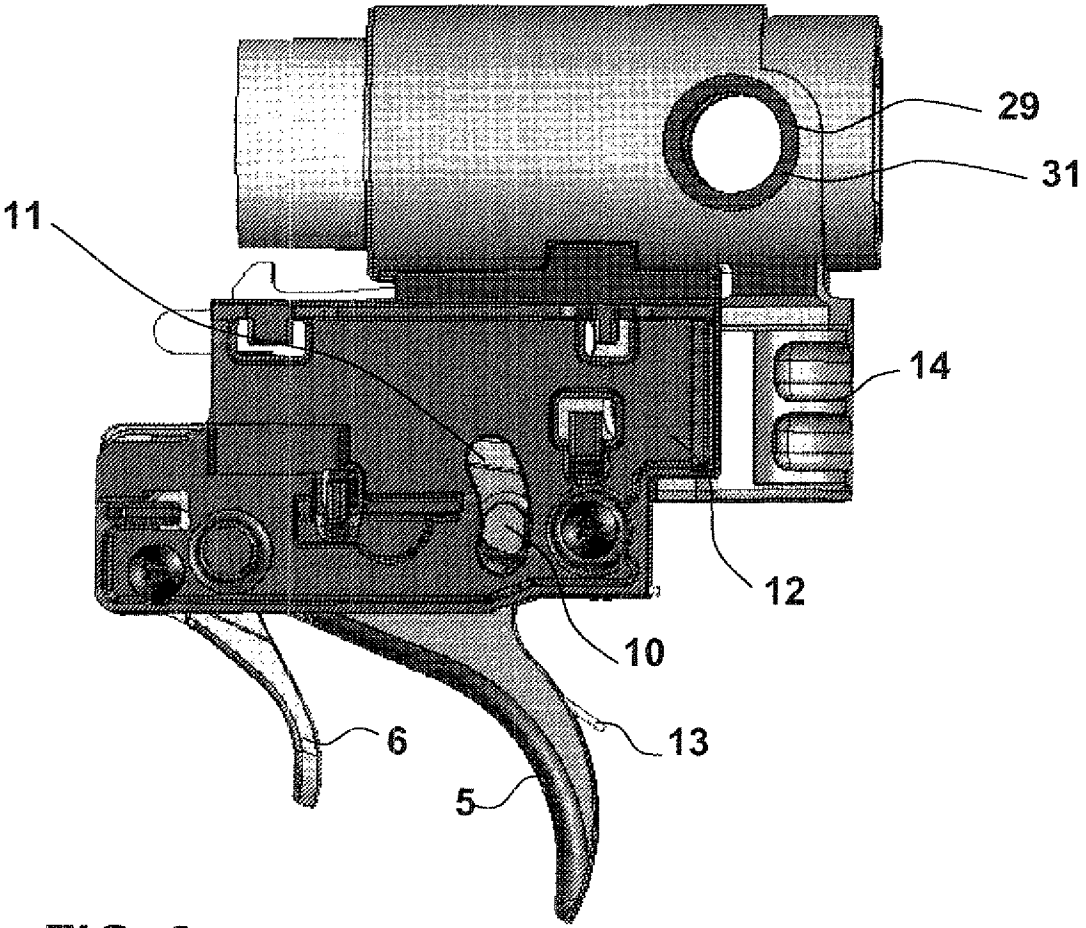
FIG. 3 is a lateral view of the referred trigger mechanism without the slider and spring guide.

FIG. 3 shows rigid profile 14, pass-through orifice 29, damping washer 31, cover 12, with aperture 11 for trigger stud 10, mentioned trigger 5, with first spring 13 and safety catch 6.

Figure 4:
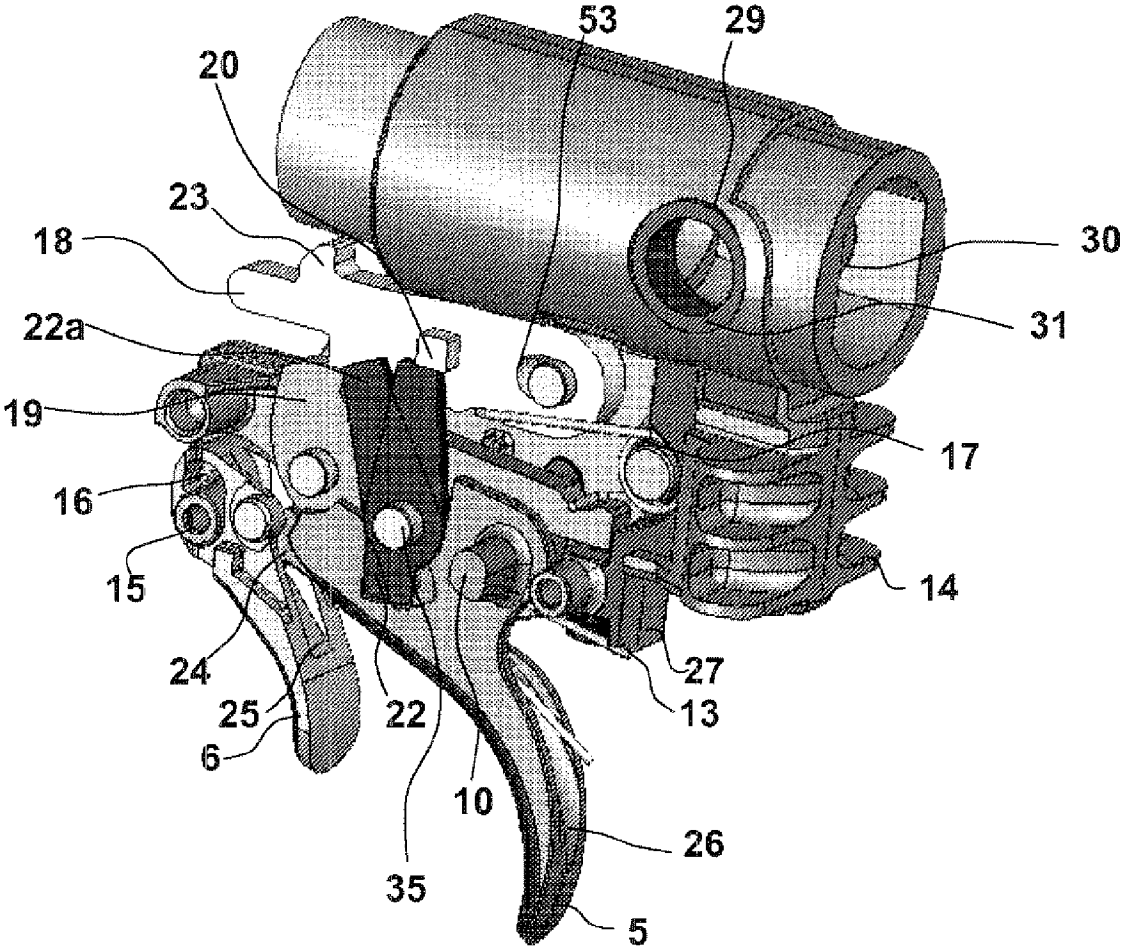
FIG. 4 is a perspective view from behind of the mentioned FIG. 3, without the cover.

FIG. 4 contains rigid profile 14, with its wall 27, pass-through orifices 29, 30, damping washer 31, safety catch 6, trigger 5, with its stud 10, its shaft 35 and its projection 24, a first slot 25, second slot 26, first spring 13, aperture 16 in the safety catch crossed by a stud 15 on the rigid profile, counterpawl 19, anti-fall safety catch 22 in initial position, anti-fall safety catch 22*a* in a second position, second spring 17 and pawl 18, with its tooth 23, its elongated mounting hole 53 and stop 20.

Figure 5:
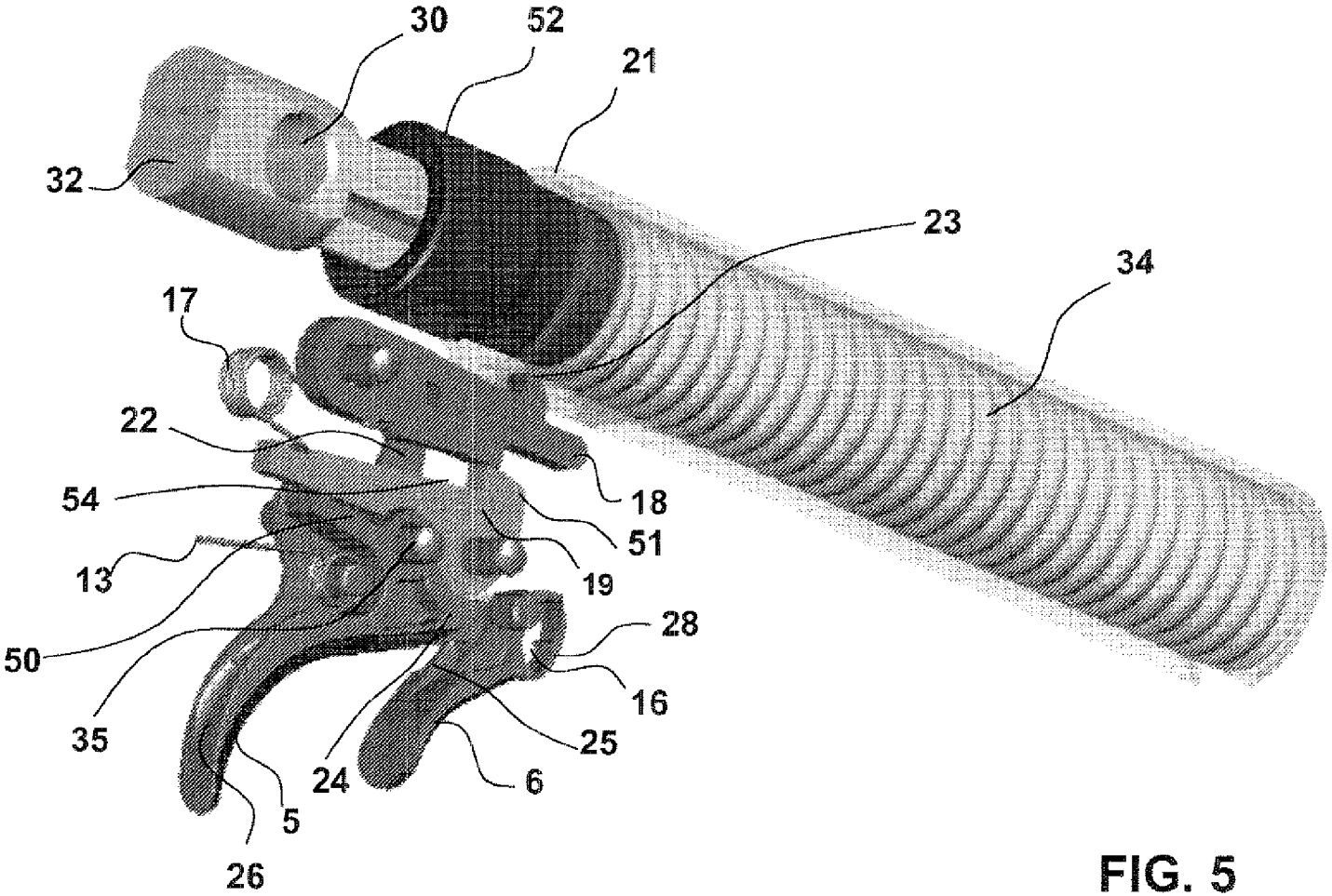
FIG. 5 is a perspective view of FIG. 4 from behind, without the rigid profile, from below on the right side, with the spring guide shaft and a transparent piston.

Finally, FIG. 5 shows trigger 5, trigger shaft 35, its projection 24, first slot 25, second slot 26, first spring 13, second spring 17, safety catch 6, with its aperture 16, throttle point 28, counter pawl 19, with its necking 54, and interference zone 51, anti-fall safety catch 22, pawl 18, with its tooth 23, contact zone 50, spring 34, spring guide 32 with pass-through orifice 30, spacer 52 and piston 21.

In this way, in a specific exemplary embodiment, the sportsman first loads the rifle by breaking barrel 1. This means by gripping barrel 1 and chamber 4 they will articulate by the first and second articulations 7, 8, which allows the pellet or similar to be inserted inside barrel 1.

This action assumes that lever mechanism 2 moves in the opposite direction to barrel 1 and moves rod 3 which, in turn, is coupled to slider 9, thus pushing slider 9.

Thus slider 9 is arranged on cover 12 (FIG. 2). When barrel 1 is broken, referred slider 9 blocks the movement of first stud 10 along aperture 11. This immobilises trigger 5 and hence, the rifle cannot fire.

When barrel 1 is closed, rod 3 pulls the slider 9 in the forward direction of the pellet or similar and releases first stud 10 through aperture 11, thus permitting trigger 5 operation.

In order to allow trigger 5 operation by the sportsman, it is first necessary to release safety catch 6 (FIGS. 4 and 5). The trigger comprises projection 24 that is introduced into first slot 25, belonging to mentioned safety catch 6. In this way, if safety catch 6 is not released, when attempts are made to move trigger 5, projection 24 remains blocked by safety catch 6 and hence, trigger 5 is blocked and the sporting rifle cannot be fired.

Safety catch 6 comprises kidney-shaped aperture 16, with choke point 28, which defines the two halves, upper and lower ones. Said aperture is crossed by fixed stud 15, belonging to rigid profile 14. In the safety position in this exemplary embodiment, stud 15 is in the lower half of aperture 16, blocking all possible action of trigger 5 and is assisted by throttle point 28 that stabilises the safety catch position.

When safety catch 6 is moved by a finger, it overcomes the resistance of throttle point 28 and safety catch 6 moves leaving stud 15 in the upper half of aperture 16, with trigger 5 in the unblocked position.

Then, when the sportsman presses trigger 5, this rotates on trigger shaft 35, moves the anti-fall safety catch 22 from a first position in which it is in contact with stop 20 to a second position 22*a* in which it is moved away from said stop 20.

Thus, said trigger shaft 35 crosses trigger 5 and anti-fall safety catch 22.

Anti-fall safety catch 22 is intended to prevent the pawl 18 from coming down until the trigger is no longer pressed. In this way, when anti-fall safety catch 22 from stop 20 of pawl 18, pawl 18 is then able to move downwards.

Moreover, contact zone 50 of trigger 5 with counterpawl 19 causes trigger 5 to rotate due to finger pressure of the sportsman, this contact zone 50 rotates counter pawl 19 which reduces the space of interference zone 51 and releases pawl 18 which then falls due to the action of the vertical force component that piston 21 exerts on tooth 23, pushed by spring 34. Tooth 23 releases rifle piston 21, which then fires.

After firing, finger pressure is removed from trigger 5, first spring 13 and second spring 17 return the various elements to their initial positions except safety catch 6, which is left in manual operation by the sportsman.

Elongated mounting hole 53 (FIG. 4) is used to load the rifle. When piston 21 moves backwards, it pushes pawl 18, which also moves because it is allowed to do so by elongated mounting hole 53, in this way it eliminates interference zone 51 and also the interference of anti-fall safety catch 22 with stud 20, so that pawl 18 falls into upper necking 54 of pawl 19, allowing it to pass above piston 21. When tooth 23 reaches the piston 21, tooth 23 is able to move up under the force of spring 17.

At this point, the force on piston 21 (via the barrel) is released, so that piston 21 moves back, taking tooth 23 with it, together with pawl 18 which, by means of elongated mounting hole 53, returns to interference zone 51 with pawl 19, together with anti-fall safety catch 22 and stud 20.

The purpose of the spacer 52 is to protect tooth 23 so that spring 34 does not eject it and thus free piston 21. It also used to damp rigid profile 14 to prevent spring 34 damaging it.

Vibrations from piston 21 against chamber 4 reach the pin (not shown) and are then absorbed by the damping washers 31.

Said damping washers 31 prevent vibrations and the tendency of chamber 4 to drag forward from damaging the trigger mechanism.

This invention patent describes a new trigger mechanism for sporting rifles. The examples mentioned here do not limit this invention and thus, can have various applications and/or adaptations, all of which are within the scope of the following claims.

The invention claimed is:

1. A trigger mechanism of a sporting rifle having a broken barrel position and a close barrel position and comprising a piston, a chamber, a rigid profile housing a spring guide and supporting the chamber, a trigger and a trigger safety catch, the trigger mechanism comprising:

a wall firmly attached to the rigid profile and defining faces, the trigger and the safety catch being arranged over one of the faces of the wall and another of the faces being free;

a first stud firmly attached to the trigger;

a cover that partially covers the trigger and the safety catch, the cover comprising an aperture allowing the first stud to pass therethrough and move along a length thereof; and a slider arranged over the cover, the slider blocking movement of the first stud along the length of the aperture in the broken barrel position, thus immobilizing the trigger, the slider allowing movement of the first stud along the length of the aperture in the close barrel position.

2. A trigger mechanism in accordance with claim 1 wherein the slider is coupled to a rod that is coupled to a lever mechanism of a barrel of the sporting rifle.

3. A trigger mechanism in accordance with claim 1, the trigger mechanism further comprising, between the wall and the cover, a pawl with a tooth the blocks the piston.

4. A trigger mechanism in accordance with claim 1, the trigger mechanism further comprising a first slot in the safety catch that houses a trigger projection.

5. A trigger mechanism in accordance with claim 3, the trigger mechanism further comprising a counterpawl in contact with the pawl and the trigger at the same time, and the counterpawl is similarly kinetically coupled to the trigger, with a first portion of the counterpawl blocking movement of the pawl and releases the blocking when the trigger is moved.

6. A trigger mechanism in accordance with claim 5 wherein the counterpawl comprises an upper necking.

7. A trigger mechanism in accordance with claim 5, the trigger mechanism further comprising an anti-fall safety catch associated with the trigger in contact stop on the pawl and immobilizing the pawl.

8. A trigger mechanism in accordance with claim 7, the trigger mechanism further comprising a trigger shaft that passes through the trigger and the anti-fall safety catch.

9. A trigger mechanism in accordance with claim 7 wherein the trigger comprises a second slot that contains a first spring.

10. A trigger mechanism in accordance with claim 5, the trigger mechanism further comprising a second spring compressed by the pawl and the counterpawl.

11. A trigger mechanism in accordance with claim 1 further comprising an aperture in the safety catch for a second stud and the aperture comprising a throttle point defining two spaces, a first of the spaces blocking the trigger and a second of the spaces releasing the trigger.

12. A trigger mechanism in accordance with claim 11 wherein the aperture in the safety catch has a kidney shape.

13. A trigger mechanism in accordance with claim 1 wherein the rigid profile comprises pass-through orifices and damper washers arranged over the pass-through orifices.

14. A trigger mechanism in accordance with claim 5, the trigger mechanism further comprising a spacer located at an end of the piston and a spring surrounding the piston.

* * * * *